US006614006B2

(12) United States Patent
Pastore et al.

(10) Patent No.: US 6,614,006 B2
(45) Date of Patent: Sep. 2, 2003

(54) DEVICE FOR DETERMINING THE LOCATION OF COOKING UTENSILS ON A COOKING HOB COMPRISING DISCRETE DISTRIBUTED HEATING ELEMENTS

(75) Inventors: Cristiano Pastore, Borgomanero (IT); Salvatore Sanna, Biandronno (IT); Daniele Turetta, Ispra (IT); Davide Gerola, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/004,210

(22) Filed: Nov. 1, 2001

(65) Prior Publication Data

US 2002/0053563 A1 May 9, 2002

(30) Foreign Application Priority Data

Nov. 8, 2000 (IT) ..... MI2000A2409

(51) Int. Cl.[7] ..... H05B 3/68; H05B 1/02

(52) U.S. Cl. ..... 219/447.1; 219/518

(58) Field of Search ..... 219/446.1, 447.1, 219/448.11, 448.12, 468.13, 460.1, 483, 490, 509, 518

(56) References Cited

U.S. PATENT DOCUMENTS

| | | | | |
|---|---|---|---|---|
| 5,136,277 A | * | 8/1992 | Civanelli et al. | 219/445.1 |
| 5,658,478 A | * | 8/1997 | Roeschel et al. | 219/502 |
| 5,893,996 A | * | 4/1999 | Gross et al. | 219/447.1 |
| 5,900,174 A | * | 5/1999 | Scott | 219/447.1 |
| 6,259,069 B1 | * | 7/2001 | Schotten et al. | 219/447.1 |

* cited by examiner

*Primary Examiner*—Sang Paik
(74) *Attorney, Agent, or Firm*—Thomas J. Roth; Robert O. Rice; Stephen Krefman

(57) ABSTRACT

A device for determining the location of cooking utensils on a cooking hob comprising a plurality of thermal cells distributed in matrix formation below a heat-resistant surface on which the cooking utensil can be located in random manner, the determination of its location, form and dimensions enabling those thermal cells lying below the utensil to be energized, the same thermal cells being also individually used for this determination.

20 Claims, 3 Drawing Sheets

DEVICE FOR DETERMINING THE LOCATION OF COOKING UTENSILS ON A COOKING HOB COMPRISING DISCRETE DISTRIBUTED HEATING ELEMENTS

BACKGROUND OF THE INVENTION

1. Field of the Invention

The present invention relates to a device for determining the location of cooking utensils on a cooking hob comprising a plurality of electrically powered thermal cells (resistors) distributed below a heat-resistant surface (for example of glass ceramic) on which at least one cooking utensil for the heat treatment (for example cooking, heating or thawing) of a food contained therein, the thermal cells being disposed in matrix formation.

2. Description of the Related Art

On these cooking hobs, known as high versatility hobs, the cooking utensil or utensils can be located at any desired point on them, for example depending on the space available, on the user's operating comfort, or even purely randomly. The heating elements which have to be operated depend on the position of the cooking utensil or utensils. Information relative to their position hence constitutes a basic element for the operation of a cooking hob of the considered type.

In WO 97/19298, information concerning this position is obtained by means for monitoring the thermal load associated with each of the heating elements. The drawback of such a solution is that it requires electrodes or similar means with relative cabling which, being located in proximity to the heating elements, is subjected to high temperature, to resist which it must be of dedicated type, and hence specific. To this must be added the fact that the large number of components and the complexity of the cabling represent costs which negatively affect the final cost of the product.

In co-pending U.S. patent application Ser. No. 09/981,035, filed Oct. 17, 2001, by Davide Gerola and Cristiano Pastore and assigned to the assignee of this application, relating to a cooking hob of matrix type describes, by way of example, a method for identifying the location of cooking utensils using a video camera which frames the cooking hob, and a touch-screen on which the cooking hob and the cooking utensils disposed on them appear. By touching with the finger the reproductions of these utensils on the screen, the user selects those heating elements underlying the cooking utensils. This although meritorious solution is complex and hence relatively costly besides having the drawback that the video camera is exposed to smoke and steam which can negatively affect its operability.

SUMMARY OF THE INVENTION

An object of the present invention is to provide a device for determining the position, and the form and size (with suitable resolution), of cooking utensils placed on a cooking hob comprising a matrix arrangement of a plurality of heating elements, in order to power those which effectively need to be powered, i.e. those below the utensil, the device being simple, reliable and economically advantageous by comprising components intended for, or already present for, other purposes.

This and further objects which will be more apparent from the ensuing detailed description are attained by a determination device in accordance with the teachings of the accompanying claims.

BRIEF DESCRIPTION OF THE DRAWINGS

The invention will be more apparent from the detailed description of preferred embodiments thereof given hereinafter by way of non-limiting example and illustrated in the accompanying drawings, in which.

DESCRIPTION OF THE PREFERRED EMBODIMENT

Figure 1:
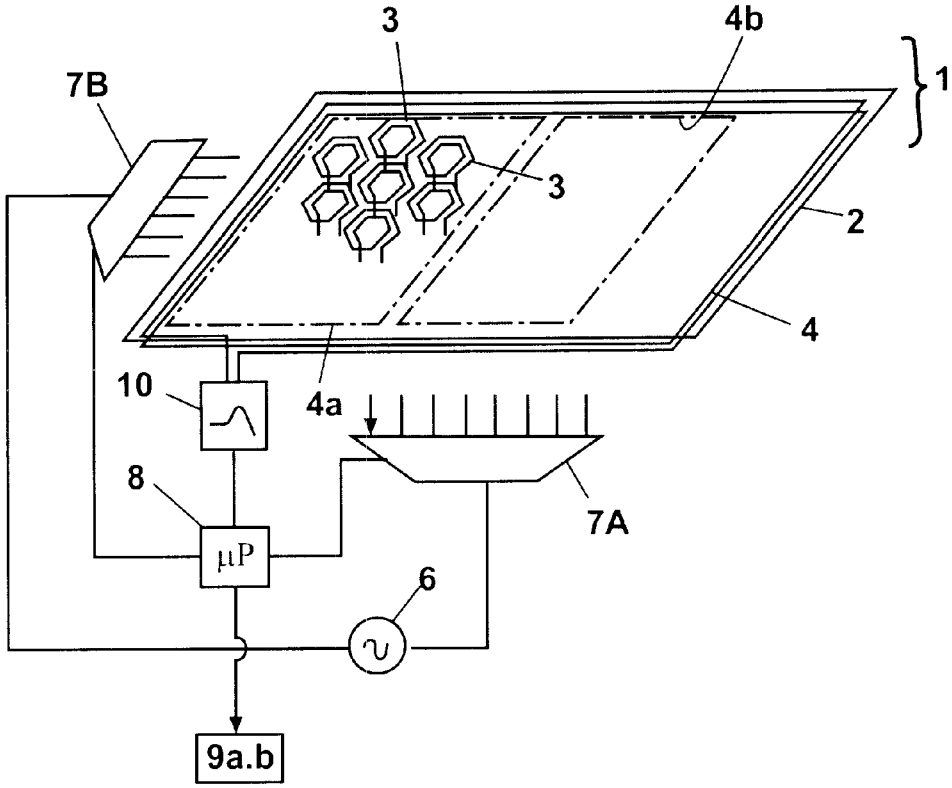
FIG. 1 is a basic schematic perspective view of a preferred embodiment of the determination device of the invention.

With reference to the figures, the reference numeral 1 indicates overall a schematically reproduced high-versatility cooking hob which, in conventional manner and as apparent for example from the aforesaid co-pending US patent application, comprises a conventional glass ceramic plate 2 on which conventional cooking utensils (saucepans, pans, frying pans, etc.) rest. Below the plate there are provided a plurality of heating elements 3, represented by metal resistors disposed for example in spiral arrangement, distributed such as to overall cover the maximum useful surface of the glass ceramic plate 2. The heating elements are arranged in matrix formation (as best seen from FIG. 2), of which conceptually each heating element can be considered an individually energizable "thermal cell", by which definition, i.e. "thermal cell" they will be identified hereinafter.

Groups of cells 3 can be energized, where each group is dedicated to a different specific cooking utensil based on its peripheral outline, as described for example in the aforesaid co-pending US patent application.

Figure 2:
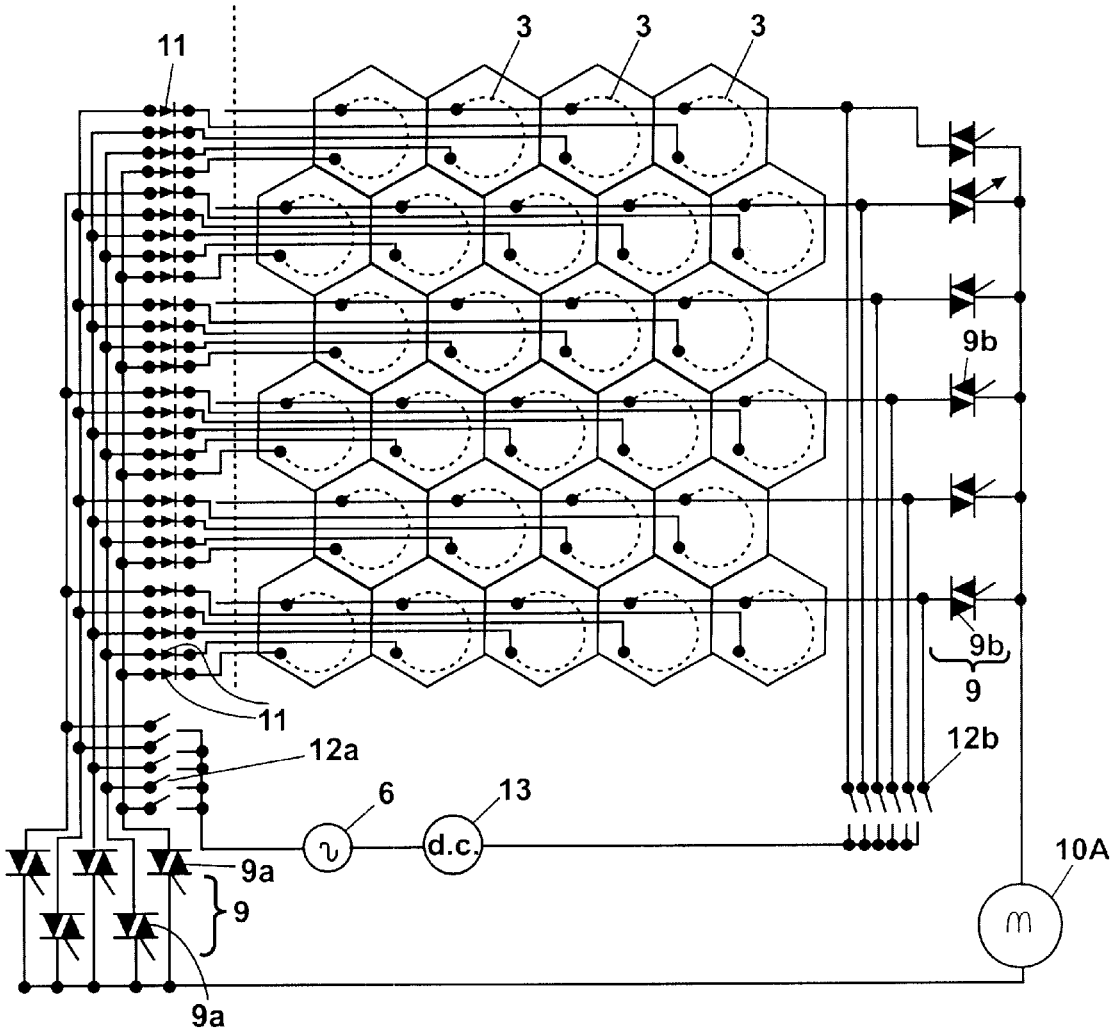
FIG. 2 is a schematic view of the device of the invention with its electrical-electronic circuitry, which also relates to the cooking hob.
Figure 2A:
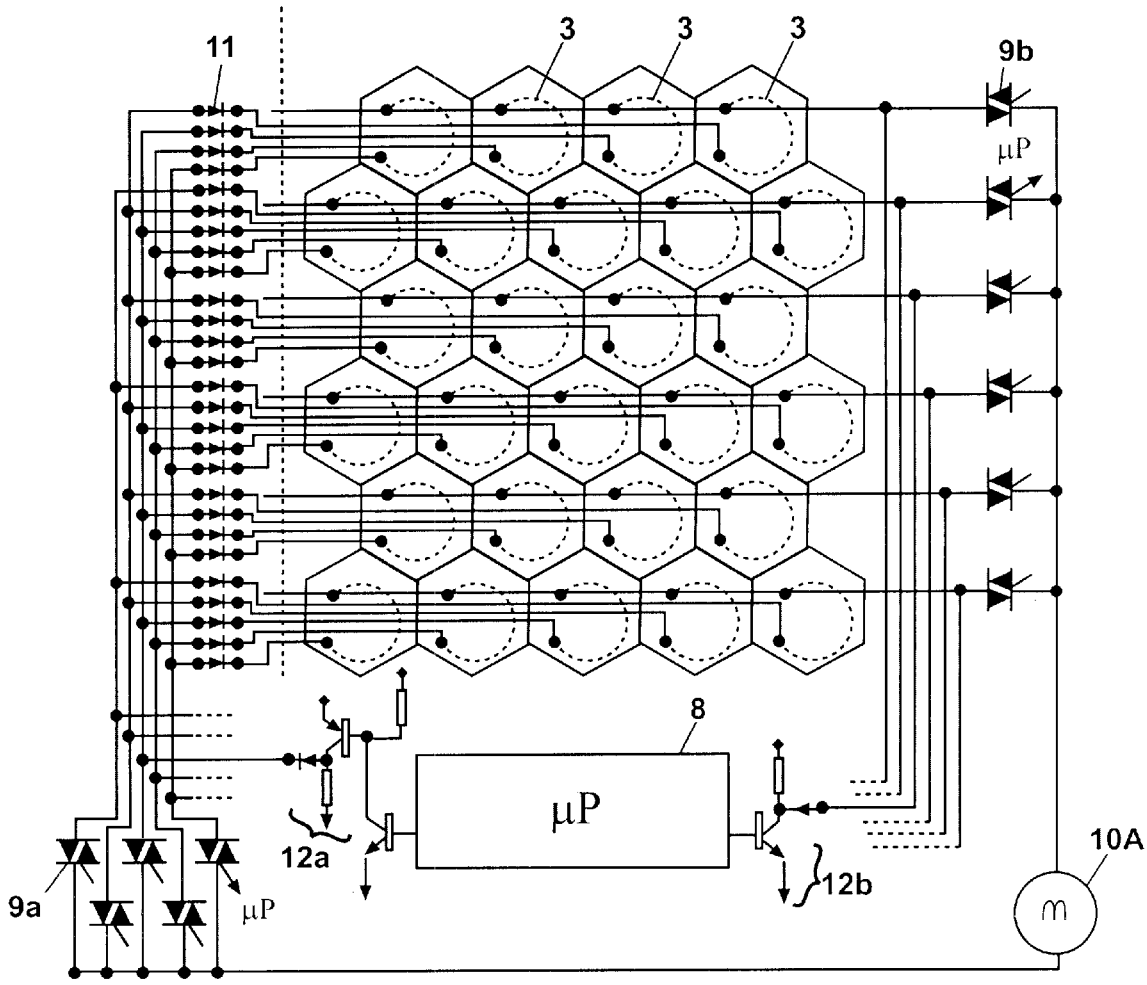
FIG. 2A shows a practical embodiment of the device of the invention.

In the embodiment of FIGS. 1, 2 and 2A of the present invention, the location of the cooking utensil or utensils, for the purpose of selecting the heating elements to be made operative, is determined using the thermal cells 3 themselves to obtain an electromagnetic coupling with a separate means 4 formed from one or more conductive loops which, in a certain sense and in this example, surround the thermal cells overall. As is evident, the scope of the invention also includes the solution comprising groups of loops, each surrounding an assigned subassembly of thermal cells, for example as illustrated in FIG. 1 with dashed and dotted lines and carrying the reference numerals 4*a* and 4*b*.

Each thermal cell, connectable to the power source 10A via (FIG. 2) solid state switches 9 program-controlled by a microprocessor 8, for example in accordance with the method stated in the aforesaid co-pending US patent application of the same applicant, can also be connected to an alternating signal source 6 via column selectors 7A and row selectors 7B (for example represented by multiplexers) both controlled by said microprocessor 8 such that the signal of the source 6 is applied, in cyclic succession, to different thermal cells 3. The signal received by the loops 4 is different depending on whether a cooking utensil lies on a thermal cell receiving the signal of the source 6.

If a utensil is present, the electromagnetic coupling between the thermal cell 3 and the loop 4 undergoes a variation. The variation is measured by a circuit 10 (for example comprising a band pass filter. amplifier, double half wave rectifier, envelope detector) the output of which reaches the microprocessor 8 via an AID converter (not shown). The microprocessor associates this signal variation with the presence/absence of the cooking utensil on the specific thermal cell which has produced it and effects such an association for each thermal cell on which the cooking utensil lies, and builds a memory map containing the overall the measurements relative to each cell. A suitable algorithm extracts from this map those thermal cells to be energized (via the solid state switches 9). The said mapping can be for example also used to display on a light-emitting panel the location of cooking utensils on the hob. It should be noted that in a preferred embodiment of the invention the thermal cell selection (for the purpose of applying to it the alternative signal of the source 6) takes place while the relative row and column are not powered with mains voltage via the aforesaid solid state switches 9. In other words, the said algorithm (or another) coordinates the sequence in which the thermal cells 3 are powered by the power source 10A (via the solid state switches 9*a*, 9*b*) with the sequence of selection operated via the multiplexer 7A, 7B.

FIG. 2 schematically shows the matrix formation of the thermal cells 3 of a cooking hob and the solid state switches 9 (9*a* for rows and 9*b* for columns, here exemplified as triacs) provided for energizing the selected thermal cells 3 via diodes 11. The energy is supplied by the unfiltered full-wave rectified electrical source 10A, in accordance with the aforesaid co-pending US patent application.

In the aforegoing it has been stated that the signal for determining the absence/presence of the cooking utensil is applied to the thermal cells 3 which hence act as a "transmitter" whereas the loops act as a "receiver" for the signal emitted by the cell itself. It is however evident that the scope of the invention includes the dual solution, in which the loops 4 act as the transmitter and the thermal cells 3 as the receiver. In this solution the loops 4 can be excited continuously or discontinuously (for example at predetermined intervals), the thermal cells 3 being enabled cyclically on receiving the signal during excitation of the loops 4.

FIG. 2A represents a practical embodiment of the invention. This figure uses the same alphanumerical references as the preceding figures to indicate equal or corresponding parts. Here, each row switch 12*b* consists of an NPN transistor with its emitter earthed and a diode connected to the collector to which a positive source is connected via a resistor, whereas the column switch 12*a* consists of an NPN transistor with its emitter earthed, its collector connected to a positive source via a resistor and to the base of a PNP transistor with its collector connected to earth via a resistor and to a column diode, its emitter being connected to a positive source. The purpose of the diodes is to protect against overvoltage. In this embodiment the row concerned is connected to earth while the column concerned is driven or is in alternating current (or vice versa).

Figure 3:
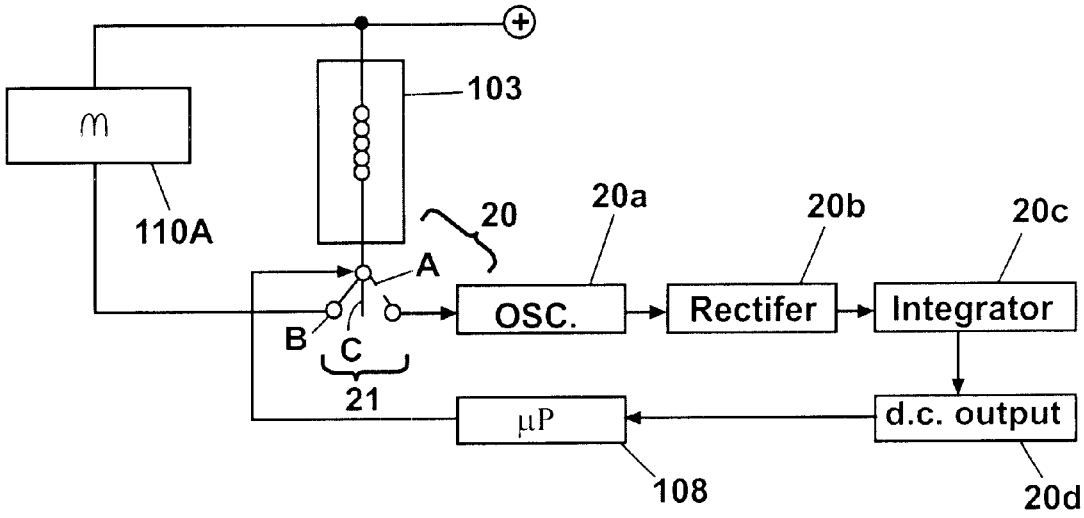
FIG. 3 shows the basic scheme of a variant of the invention.

The embodiment of FIG. 3 in which equal or corresponding parts are indicated by the preceding reference numerals plus 100, the thermal cell 103 itself constitutes an integral part of an oscillator 20 when a switching means (for example a triac), indicated by 21 and controlled by the microprocessor 108 is driven by this latter into the logic position A by which it is connected to the remaining part 20*a* of the oscillator, the oscillator being connected to a rectifier 20*b* and this to an integrator 20*c*. The d.c. output indicated by 20*d* passes to the microprocessor 108. If a cooking utensil is located on the thermal cell the oscillator characteristic varies, this variation acting on the microprocessor 108 in the sense of causing the switch 21 to assume the logic position B in which the thermal cell is connected to the power source 11 GA which energizes it, in accordance with the algorithm indicated in the aforesaid co-pending US patent application, which algorithm in alternating between energizing thermal cells 103 in logic position B and connecting thermal cells 103 as part of the oscillator in logic position A causes the switch to pass (during cut-out) to a floating position indicated by C to isolate the power source 110A from the oscillator 20. The switch 21 evidently represents a function and not the specific solution, which is obviously represented by electrical/electronic means implementing the described function.

Although the embodiment of FIG. 3 refers to a single thermal cell, it will be evident to the expert of the art how to adapt it to the plurality of thermal cells forming the cooking hob 1.

The sensing part shown in FIG. 2 comprises the alternating signal source 6, connected in series with a direct current source 13 (by which the signal of the source 6 plus the direct current source 13 will always be positive) and the selectors (multiplexers 7A, 7B) reproduced in the form of physical switches 12*a* and 12*b*, as means which cyclically provide a pulse signal to the individual thermal cells 3, as stated herein before.

The source 6 can be square wave and have a frequency of 80 kHz.

We claim:

1. A cooking hob having a plurality of thermal cells distributed in matrix formation below a heat-resistant surface on which cooking utensils can be located in random manner comprising:

means for determining the location, form and dimensions of one or more cooking utensils positioned on said cooking hob including a signal source, means for applying a signal from said signal source individually to said plurality of thermal cells, means for receiving said signal from said thermal cells, and means for processing the signal from said thermal cells to determine which thermal cells lie under said cooking utensil (s); and means for enabling those of said thermal cells lying below said cooking utensil(s) to be energized by a power source.

2. A cooking hob as claimed in claim 1, wherein the thermal cells individually act as a transmitter of electromagnetic signals from said signal source which signals are received by an electromagnetically coupled receiver means, and the content of the signal received by said receiver varies according to whether or not a cooking utensil is located on said thermal cell, and said variation is used by said means for processing signals to determine which of said thermal cells lie under said cooking utensil(s).

3. A cooking hob as claimed in claim 1, wherein said thermal cells individually act as a receiver of electromagnetic signals from said signal source which are transmitted by electromagnetically coupled transmitter means, and the content of the signal received by said thermal cells varies according to whether or not a cooking utensil is located on said thermal cell, and said variation is used by said means for processing signals to determine which of said thermal cells lie under said cooking utensil(s).

4. A cooking hob as claimed in claim 1, wherein the receiver means is formed of at least one loop surrounding at least a part of the thermal cells present.

5. A cooking hob as claimed in claim 1, wherein said means for applying a signal from said signal source comprises means for the cyclic selection of individual thermal cells for the purpose of determining the presence of said cooking utensil(s).

6. A cooking hob as claimed in claim 5, wherein first electronic selection means are provided for cyclic selection of individual thermal cells for determining the presence of said cooking utensil(s) and second electronic selection means are provided for energizing those of said thermal cells lying below said cooking utensils.

7. A cooking hob as claimed in claim 6, wherein determination of the presence of said cooking utensil(s) is alternated with energizing said thermal cells.

8. A cooking hob as claimed in claim 7, wherein said signal source includes said thermal cells forming part of an oscillator for determination of the presence of said cooking utensil(s).

9. A cooking hob as claimed in claim 1, wherein said means for applying said signal source to said thermal cells comprises electronic switch means which selectively connects the rows of the matrix distribution of thermal cells to ground and, respectively, enables the columns of the matrix distribution of thermal cells to be selectively driven with an alternating signal (or vice versa).

10. A cooking hob comprising:

a plurality of thermal cells distributed in a matrix formation below a heat-resistant surface on which one or more cooking utensils can be located in random manner;

a power supply for energizing said thermal cells;

a signal source;

a receiver electromagnetically coupled to said thermal cells;

first switching means for applying a signal from said signal source individually to said plurality of thermal cells;

second switching means for individually connecting said plurality of thermal cells to said power supply;

a signal processor for processing signals from said receiver; and a microprocessor to determine which thermal cells lie under a cooking utensil and map those thermal cells which lie under a cooking utensil based on signals from said signal processor and to generate an algorithm to cause said switching means to connect those of said thermal cells lying under a cooking utensil to said power supply to be energized.

11. The cooking hob as claimed in claim 10, wherein said receiver comprises at least one loop surrounding at least a part of said thermal cells.

12. The cooking hob of claim 11 wherein said receiver comprises multiple loops each surrounding at least a portion of said thermal cells.

13. The cooking hob of claim 10 wherein said first switching means and said second switching means alternately applies said signal from said signal source individually to said thermal cells and enables those thermal cells lying under a cooking utensil to be energized by said power source.

14. A method for determining the location, form and size of cooking utensils on a cooking hob having a plurality of thermal cells distributed in a matrix formation below a heat-resistant surface on which cooking utensils can be located in random manner comprising:

applying a signal from a signal source individually to said thermal cells;

receiving a signal from said thermal cells which received signal varies according to whether or not a cooking utensil is located on said thermal cell;

processing said received signals in a circuit to provide an output that indicates whether said thermal cells lies under a cooking utensil.

15. The method of determining the location, form and size of cooking utensils on a cooking hob according to claim 14 wherein said received signal is received by receiving means electromagnetically coupled to said thermal cells.

16. The method of determining the location, form and size of cooking utensils on a cooking hob according to claim 14 further comprising:

providing the outputs of said circuit to a microprocessor to build a memory map of the location, form and size of cooking utensils on said cooking hob based on the outputs associated with each thermal cell.

17. The method of determining the location, form and size of cooking utensils on a cooking hob according to claim 16 further comprising:

using said memory map to display on a light-emitting panel the location of cooking utensils on said cooking hob.

18. The method of determining the location, form and size of cooking utensils on a cooking hob according to claim 14 further comprising:

providing the outputs of said circuit to a microprocessor to build a memory map of the location, form and size of cooking utensils on said cooking hob based on the outputs associated with each thermal cell and applying an algorithm to extract from said map those of said thermal cells to be energized by a power source.

19. A method of determining the location, form and size of cooking utensils on a cooking hob having a plurality of thermal cells distributed in a matrix formation below a heat-resistant surface on which cooking utensils can be located in random manner to select thermal cells lying below a cooking utensil to be energized comprising:

applying a signal from a signal source individually to said thermal cells;

receiving a signal from said thermal cells which received signal varies according to whether or not a cooking utensil is located on said thermal cell;

processing said received signals in a circuit to provide an output that indicates whether said thermal cells lies under a cooking utensil;

providing the outputs of said circuit to a microprocessor to build a memory map of the location, form and size of cooking utensils on said cooking hob based on the outputs associated with each thermal cell; and applying an algorithm to extract from said map those thermal cells to be energized by a power source.

20. The method of determining the location, form and size of cooking utensils on a cooking hob according to claim 19 further comprising:

using said memory map to display on a light-emitting panel the location of cooking utensils on said cooking hob.

* * * * *